US007733298B2

(12) United States Patent
Anderson et al.

(10) Patent No.: US 7,733,298 B2
(45) Date of Patent: Jun. 8, 2010

(54) DISPLAY DEVICE

(75) Inventors: Daryl E. Anderson, Corvallis, OR (US); Mark A. Rice, Independence, OR (US); Andrew L. Van Brocklin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1632 days.

(21) Appl. No.: 10/969,401

(22) Filed: Oct. 19, 2004

(65) Prior Publication Data

US 2006/0082874 A1 Apr. 20, 2006

(51) Int. Cl.
*G09G 3/20* (2006.01)

(52) U.S. Cl. ..... 345/55

(58) Field of Classification Search ..... 345/82, 345/204, 506, 522, 519, 545, 98, 87, 89, 345/629, 55, 8, 158, 173, 503; 359/464, 359/478, 822, 25, 497; 353/63, 84, 7; 348/58, 348/312, 296, 298, 371, 14.12, 311, 338.03, 348/190, 203; 725/151; 710/100; 365/151; 386/38; 250/227.14; 257/347, 14; 342/59; 180/273; 358/3.28; 380/230; 600/478, 431; 382/128, 199

See application file for complete search history.

(56) References Cited

U.S. PATENT DOCUMENTS 4,347,530 A 8/1982 Stetson
4,374,397 A 2/1983 Mir
4,463,380 A * 7/1984 Hooks, Jr. ..... 348/580
4,467,325 A 8/1984 Lustig
4,636,027 A * 1/1987 Dube ..... 359/25
4,646,079 A 2/1987 Kitai et al.
4,655,542 A * 4/1987 Dube ..... 359/1
4,832,429 A 5/1989 Nagler
5,095,521 A * 3/1992 Trousset et al. ..... 345/421
5,321,750 A * 6/1994 Nadan ..... 380/230
5,341,141 A * 8/1994 Frazier et al. ..... 342/59
5,485,225 A 1/1996 Deter et al.
5,566,012 A 10/1996 Koshimizu et al.
5,617,132 A 4/1997 Fisli
5,715,021 A 2/1998 Gibeau et al.
5,751,295 A * 5/1998 Becklund et al. ..... 345/503
5,825,400 A * 10/1998 Florence ..... 347/239
5,920,361 A 7/1999 Gibeau et al.
5,936,767 A 8/1999 Favalora
6,259,838 B1 * 7/2001 Singh et al. ..... 385/31
6,260,088 B1 * 7/2001 Gove et al. ..... 710/100
6,278,538 B1 8/2001 Schleipen
6,307,589 B1 * 10/2001 Maquire, Jr. ..... 348/333.03
6,312,960 B1 * 11/2001 Balch et al. ..... 506/32
6,314,210 B1 11/2001 Fukushima et al.
6,351,324 B1 2/2002 Flint
6,612,703 B2 9/2003 Lowenthal et al.
6,674,415 B2 * 1/2004 Nakamura et al. ..... 345/32
6,714,187 B2 * 3/2004 Nagakubo et al. ..... 345/158
6,769,774 B2 * 8/2004 McDowell ..... 353/84
6,803,238 B1 * 10/2004 Eggers ..... 436/518
6,857,746 B2 * 2/2005 Dyner ..... 353/28
6,859,338 B2 * 2/2005 Johnson ..... 359/822
6,867,752 B1 * 3/2005 Yamazaki et al. ..... 345/8

(Continued)

*Primary Examiner*—Prabodh M Dharia

(57) ABSTRACT

In various embodiments, a display device can include a number of pixel cells and a number of receptor cells. Each receptor cell can be coupled to a group of pixel cells within the number of pixel cells, and each receptor cell can receive encoded pixel data and decode the encoded pixel data.

56 Claims, 8 Drawing Sheets

U.S. PATENT DOCUMENTS 7,119,779 B2 * 10/2006 Huang ..... 345/96
7,130,458 B2 * 10/2006 Bartell ..... 382/128
7,196,317 B1 * 3/2007 Meissner et al. ..... 250/227.14
7,288,751 B2 * 10/2007 Cartlidge et al. ..... 250/208.1
7,474,296 B2 * 1/2009 Obermeyer et al. ..... 345/156
2002/0005826 A1 * 1/2002 Pederson ..... 345/82
2002/0101587 A1 * 8/2002 Wilson et al. ..... 356/328
2003/0011751 A1 1/2003 Sakata et al.
2003/0021037 A1 1/2003 Nemes
2003/0035190 A1 2/2003 Brown et al.
2003/0038812 A1 * 2/2003 Bartell ..... 345/581
2003/0058190 A1 3/2003 Lewis et al.
2003/0081304 A1 5/2003 Harada et al.
2003/0111965 A1 6/2003 Allen et al.
2003/0189731 A1 * 10/2003 Chang ..... 358/3.28
2003/0209893 A1 * 11/2003 Breed et al. ..... 280/735
2003/0210461 A1 * 11/2003 Ashizaki et al. ..... 359/443
2004/0023249 A1 * 2/2004 Balch ..... 435/6
2004/0036969 A1 * 2/2004 Taniguchi et al. ..... 359/443
2004/0046714 A1 * 3/2004 Brown Elliott ..... 345/55
2004/0070588 A1 * 4/2004 Harrington et al. ..... 345/629
2004/0075906 A1 * 4/2004 Sedlmayr ..... 359/497
2004/0085271 A1 * 5/2004 Koll et al. ..... 345/82
2004/0129478 A1 * 7/2004 Breed et al. ..... 180/273
2004/0196234 A1 * 10/2004 Shiomi et al. ..... 345/89
2004/0202577 A1 * 10/2004 McNeil et al. ..... 422/82.08
2005/0056787 A1 * 3/2005 Cong et al. ..... 250/343
2005/0057803 A1 * 3/2005 Cruz-Uribe et al. ..... 359/443
2005/0088736 A1 * 4/2005 Ghozeil et al. ..... 359/443
2005/0104965 A1 * 5/2005 Anderson ..... 348/190
2005/0162389 A1 * 7/2005 Obermeyer et al. ..... 345/161
2005/0218397 A1 * 10/2005 Tran ..... 257/14
2005/0247978 A1 * 11/2005 Weng et al. ..... 257/347
2005/0269608 A1 * 12/2005 Yi ..... 257/292
2005/0282208 A1 * 12/2005 Adams et al. ..... 435/6
2005/0286123 A1 * 12/2005 Abu-Ageel ..... 359/443
2005/0288594 A1 * 12/2005 Lewkowicz et al. ..... 600/478
2006/0066595 A1 * 3/2006 Sampsell et al. ..... 345/204
2006/0072015 A1 * 4/2006 Anderson et al. ..... 348/203
2007/0268577 A1 * 11/2007 Whitehead et al. ..... 359/443
2008/0024639 A1 * 1/2008 Ajioka ..... 348/311

* cited by examiner

DISPLAY DEVICE

INTRODUCTION

Projection systems include front and rear projection passive displays, among others. These systems use optical energy from the projector to display an image on a projection surface.

In some projection systems, the projector and projection surface may not be fixed with respect to each other. In these instances, the angle of the projector to the projection surface may distort the viewed imaged.

Additionally, the use of mirrors and lenses to change the focus and direction of the visible light can affect image quality in various ways.

In some projection systems, the flicker of the light source can also affect the quality of the projected image.

Some projection systems may also be generally expensive due in part to the cost of the optics used to focus the visible light. Additionally, some projection systems may consume significant amounts of power in generating the optical energy used to project the image. These systems can also generate significant amounts of heat, which may damage the projection system or components thereof. Accordingly, design features used to cool the system may further add to the expense of such systems.

Additionally, the dimensions and weight of some projection systems can make them impractical for certain personal and commercial use applications.

DETAILED DESCRIPTION

Figure 1:
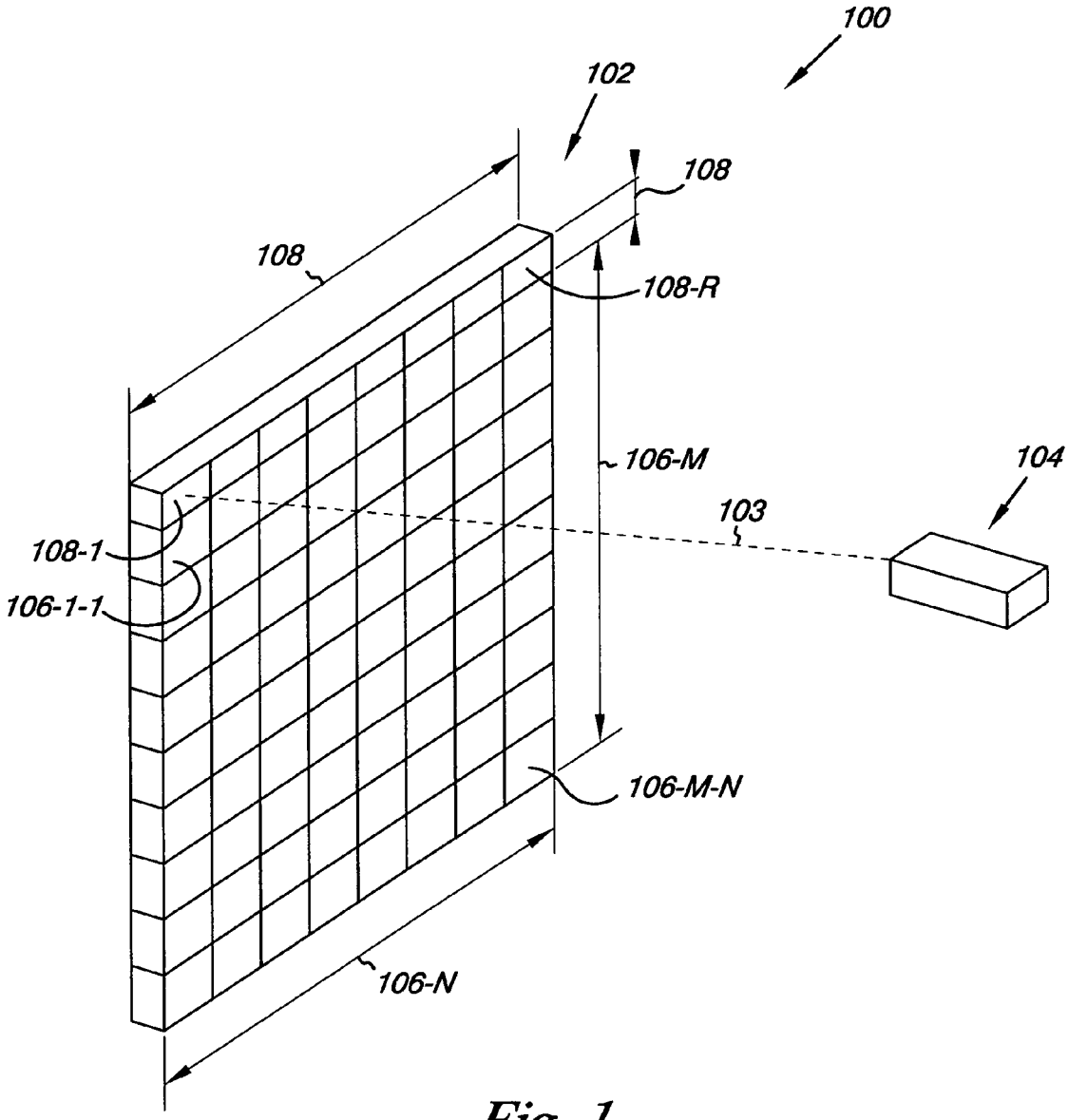
FIG. 1 illustrates an embodiment of a display system.

Embodiments disclosed herein provide methods, systems, and devices for forming an image by the activation of pixel cells from image data, i.e., pixel data, sent to the pixel cells from a data transmitter. Embodiments of the present disclosure include device embodiments having a number of pixel cells and a number of receptor cells for conveying pixel data. In various embodiments, each receptor cell is coupled to a group of pixel cells within the number of pixel cells, such that each receptor cell can receive the pixel data and convey the pixel data to the group of pixel cells for forming an image.

Device embodiments also include devices having a number of pixel arrays. In these embodiments, each pixel array includes a receptor cell, a group of pixel cells, and circuitry coupling the group of pixel cells and the receptor cell. The receptor cell receives encoded data sent from a transmitter and the circuitry decodes the encoded data and conveys the decoded data to the group of pixel cells to activate each pixel cell in the group of pixel cells.

Various embodiments also include a transmitter to send the pixel data to each of the number of receptor cells. Some embodiments include methods for receiving data in a receptor cell of a pixel array including the receptor cell and a group of pixel cells and decoding the data with circuitry housed within each receptor cell.

The figures herein follow a numbering convention in which the first digit or digits correspond to the drawing figure number and the remaining digits identify an element in the drawing. Similar elements between different figures may be identified by the use of similar digits. For example, 102 may reference element "102" in FIG. 1, and a similar element may be referenced as 202 in FIG. 2A. As will be appreciated, elements shown in the various embodiments herein can be added, exchanged, and/or eliminated so as to provide a number of additional embodiments.

In various embodiments, the display system includes a matrix of pixel cells 106 having M columns and N rows. For example, as shown in FIG. 1, pixel cell 106-1-1 includes a pixel cell positioned in the first column and the first row of the display device 102 and pixel cell 106-M-N includes a pixel cell positioned in the last column and the last row of the display device 102. The designators M, N, P, and R can each represent any number, and the use of such designators for these elements should not be viewed as limiting the quantities of the other elements illustrated or described herein.

FIG. 1 illustrates an embodiment of a display system. As shown in the embodiment of FIG. 1, the display system 100 can include a display device 102 and a transmitter 104. Display device 102 can include an optically addressable display having a number of pixel cells 106. As used herein, a number of pixel cells can include the total number of pixel cells on a display device.

In various embodiments, the display device 102 can include a number of receptor cells 108. As used herein, a number of receptor cells can include the total number of receptor cells on a display device.

In various embodiments, the display system 100 can include a transmitter 104 to send pixel data 103 to each of the number of receptor cells 108. For example, transmitter 104, as shown in FIG. 1, sends pixel data 103 to a number of receptor cells, e.g. receptor cell 108-1. In various embodiments, transmitter 104 can scan across a number of receptor cells 108-1 through 108-R to provide pixel data 103 to the receptor cells 108-1 through 108-R for displaying an image, as will be discussed more thoroughly below.

Figure 2A:
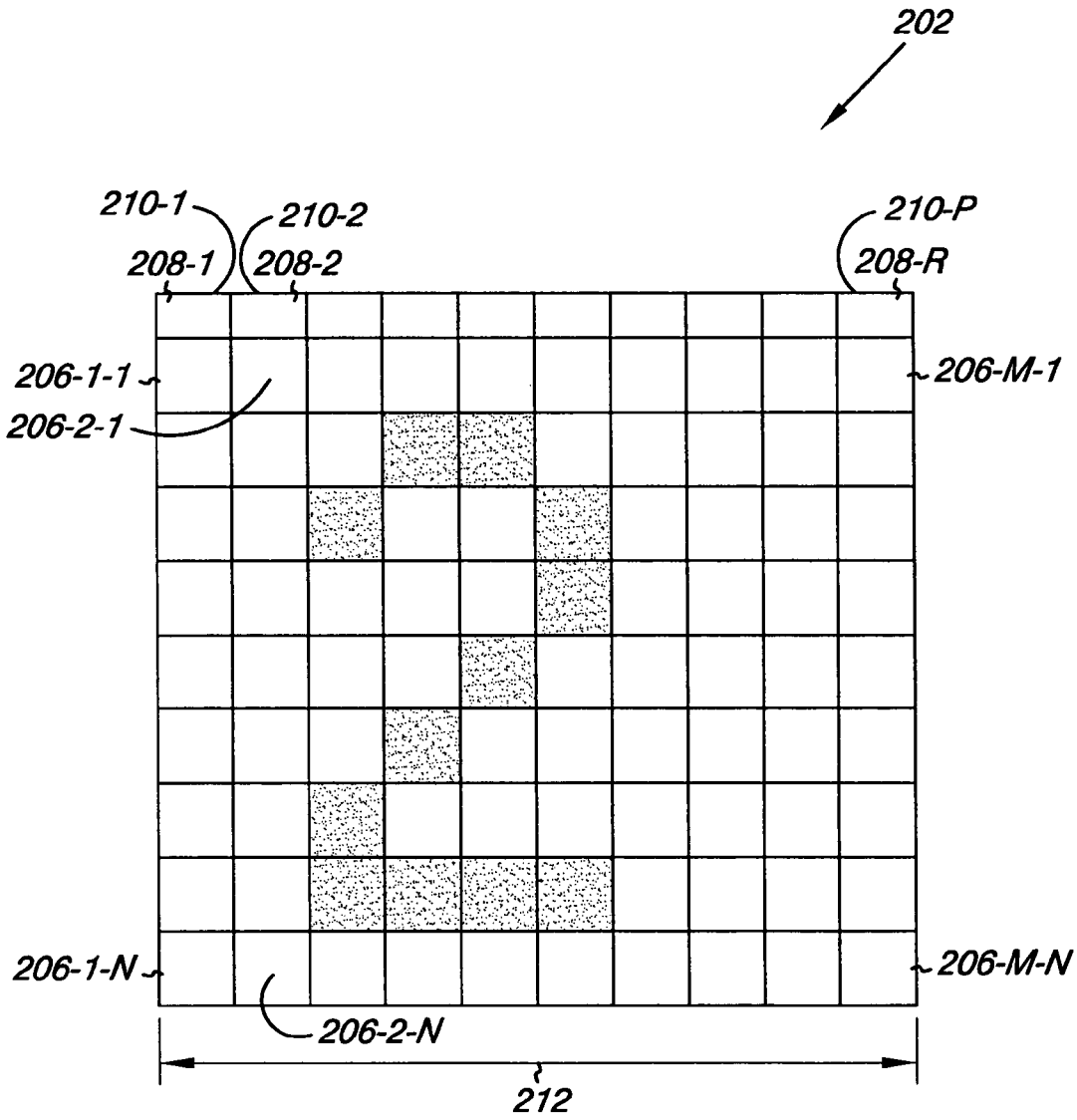
FIG. 2A illustrates an embodiment of a display device.
Figure 2B:
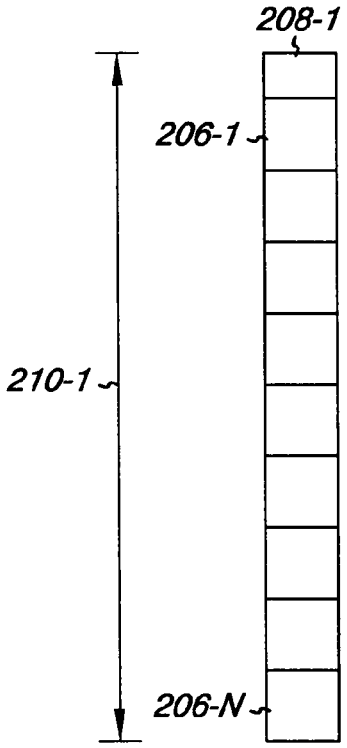
FIG. 2B illustrates an embodiment of a pixel array.

FIGS. 2A and 2B illustrate embodiments of a display device and a pixel array respectively. As used herein, a pixel array is a group of pixel cells associated with a receptor cell. For example, in FIG. 2B, the pixel array 210-1 includes a group of pixel cells 206-1 to 206-N arranged in a column and receptor cell 208-1 positioned at the top of the group of pixel cells 206-1 through 206-N.

In various embodiments, the display device can include a number of pixel arrays positioned adjacent each other. For example, the embodiment of FIG. 2A includes a number of pixel arrays 210-1 to 210-P positioned adjacent each other across the display device 202. In the embodiment of FIG. 2A, each pixel array includes a receptor cell and a group of pixel cells. Thus, in various embodiments, the display device can include an optically addressable display having a number of pixel arrays spanning across the display.

In FIG. 2A, the number of pixel arrays spanning across the display includes groups of pixel cells within the number of pixels 206-1-1 to 206-M-N and receptor cells 208-1 through 208-R. In various embodiments, each pixel array is positioned adjacent each other. For purposes of clarity, FIG. 2A provides an example of two pixel arrays adjacent each other. As shown in FIG. 2A, a first pixel array 210-1 includes receptor cell 208-1 positioned above a group of pixel cells 206-1-1 to 206-1-N. The second pixel array 210-2 includes receptor cell 208-2 positioned above a group of pixel cells 206-2-1 to 206-2-N, where N corresponds to the number of rows of pixel cells on the display device. Thus, if a display device includes a resolution of 768 rows and 1024 columns, such as in an XGA monitor, the group of pixel cells in each pixel array would include 768 pixel cells, and N=768.

In various embodiments, the receptor cells are positioned in a row at the top of the display device, and groups of pixel cells are arranged in columns below the receptor cells, as illustrated in FIG. 2A. In some embodiments however, receptor cells can be positioned in a column and the groups of pixel cells associated with each receptor cell can be arranged in rows next to the receptor cells. For example, receptor cells can be positioned vertically along the left most column of a display device and groups of pixel cells can span the width of display device in rows beginning from the second left most column to the right most column of the display device. However, embodiments of the present disclosure are not limited to such orientations and any suitable arrangement of a group of pixels cells associated with a receptor cell can be used.

For example, in various embodiments, a group of pixels can be arranged in columns and/or rows as discussed above. Thus, in some embodiments, a pixel array can include a receptor cell associated with one or more columns of pixel cells and/or one or more rows of pixel cells. Embodiments can also include a receptor cell associated with a number of partial columns and/or partial rows of pixel cells. Thus, in these embodiments, each receptor cell can be associated with multiple columns and/or rows of pixel cells.

Figure 2C:
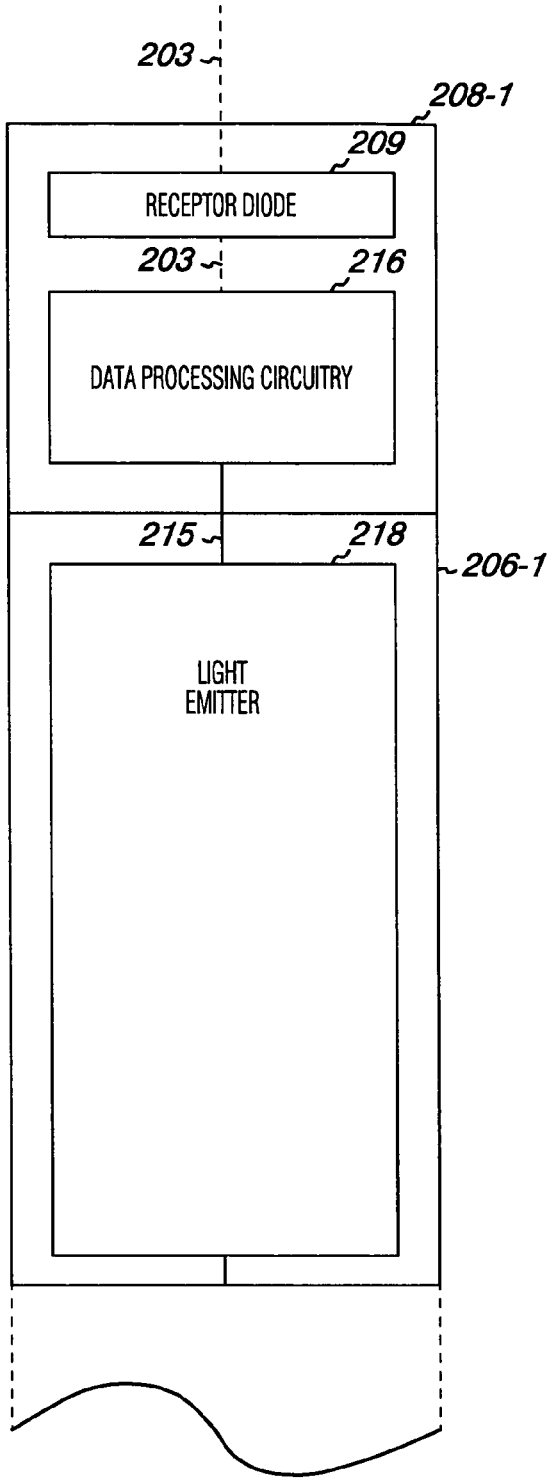
FIG. 2C illustrates an embodiment of a receptor cell and a pixel cell.

FIG. 2C illustrates an embodiment of a receptor cell and a pixel cell. Receptor cells can be oriented in a number of ways. For example, receptor cells may be oriented to receive pixel data from the front of the display device, as will be discussed below with respect to FIG. 3A, or from the back of the display device, as will be discussed below with respect to FIG. 4B.

In various embodiments, circuitry can be provided with and/or in receptor cells and/or pixel cells. In some embodiments, for example, the circuitry can be used to associate a group of pixel cells with a receptor cell. Circuitry, such as data processing circuitry, can receive encoded data, decode the encoded data, and convey the decoded data to groups of pixel cells.

The receiving, decoding, and conveying functions can also be accomplished by computer executable instructions. In these embodiments, the receptor cells 208-1 through 208-R can include a processor. The receptor cells can also include memory in some embodiments. The memory can be used, for example, to hold the computer executable instructions and other information useful in providing the above described functions. Memory can include the various volatile and non-volatile memory types, such as ROM, RAM, and flash memory, for example. Computer readable medium, as it is used herein, includes the various types of memory within a display system or device.

In various embodiments, the decoded data can be conveyed from a receptor cell to the pixel cells in a group of pixel cells. For example, in some embodiments, a receptor cell receives encoded data sent from a transmitter and the circuitry decodes the encoded data and conveys the decoded data to the number of pixel cells to activate each pixel cell in the number of pixel cells. As used herein, activating means to illuminate one or more pixel cells based upon data received.

As shown in FIG. 2C, receptor cell 208-1 can include a receptor diode 209 for receiving encoded data 203 and data processing circuitry 216 for decoding data and conveying decoded data 215 to pixel cells associated with the receptor cell, such as pixel cell 206-1.

In various embodiments, pixel cell 206-1 can include circuitry for receiving decoded data 215. The decoded data 215 is used by pixel cell 206-1 to activate light emitter 218 associated with the pixel cell 206-1. The light emitter can be emissive, transmissive, or reflective and can control monochrome or color light in the visible-light spectrum for displaying images. However, embodiments of the present disclosure are not limited to any particular type of pixel cell or components thereof.

Decoded data 215 can include data that specifies the expression of color characteristics, such as color depth and color intensity, among others. The amount of color a pixel cell can express can be referred to as the pixel cell's color depth. The color depth can be expressed in bit units. For example, a 1 bit pixel can express 2 colors or a color and no color (e.g., monochrome), an 8 bit pixel cell can express 256 colors, and a 24 bit pixel cell can express millions of colors. Accordingly, in various embodiments, pixel cell 206-1 can be provided having 32, 24, 16, 8, 4, or 1 bit color depths.

As shown in the embodiment of FIG. 2A, the display device 202 displays an image in the form of a number two. To form the image of the number two, a number of pixel cells within the various groups of pixel cells on the display device emit light. The emitted light is based on activating the portion of pixel arrays that are to be used to form the number two. The activation of the pixel cells is based on decoded data.

It will be appreciated from reading the present disclosure that displays having small numbers of pixel cells are illustrated in various FIGS. 1-4C for the sake of providing a clear example for the reader and that the embodiments of the present disclosure can include a display having more or less pixel cells, receptor cells, transmitters, and other components. For example, one suitable design includes a display device having a resolution of 768×1024, i.e., 768 rows and 1024 columns of pixel cells. In such embodiments, the display device can include 1024 pixel arrays with each pixel array including a receptor cell and 768 pixel cells, for example.

In various embodiments, a transmitter can send pixel data for reception by receptor cells. The pixel data can include data to activate each pixel cell in a group of pixel cells. For example, a receptor cell for each pixel array can be configured to convey encoded data to circuitry housed within the receptor cell. The conveying of the pixel data can be accomplished, for example, by shifting the data to the pixel cells, among other methods of conveying the data. Shifting techniques can include techniques such as the use of shift registers to convey the pixel data to each pixel cell in a group of pixel cells.

For example, in some embodiments, circuitry within each receptor cell can be configured to decode the encoded data, e.g., decode one packet of encoded data. Decoded pixel data can, for example, contain pixel information and a header. The header can be, or can include, a start bit for initiating the conveying of the pixel data to a group of pixel cells associated with the receptor cell.

In some embodiments, a number of shift registers can be used to facilitate the conveying of the pixel data to the group of pixel cells. For example, after the packet of pixel data has been decoded, shift registers, associated with the group of pixel cells, can shift the decoded data through the group of pixel cells associated with the receptor cell that decoded the encoded data.

In such embodiments, the pixel cells in a group of pixel cells can be serially arranged. When the pixel data is passed to the pixel cells in such embodiments, it passes through each pixel cell until it reaches the last cell. In this embodiment, within each pixel cell are a number of shift registers that each holds a bit of data. When the data enters the last cell, the data fills the registers until there are no empty register bits. Once the registers in a pixel cell are full, the pixel data begins to fill the next pixel cell, until the pixel cells in the group of pixel cells are full.

The pixel data can include color characteristic data such as color depth and color intensity values for each pixel, as discussed above with regard to FIG. 2C. Once the pixel cells in the group of pixel cells have received the conveyed pixel data (e.g., each pixel cell has received, for example, 24 bits of data) a latch signal can be sent to the group of pixel cells. The latch signal causes each pixel cell in the group of pixel cells to express the pixel data through illumination of the light source of the pixel cell by causing the pixel cell to emit light representative of the 24 bits of color data.

In some embodiments, the pixel information can be moved from the shift registers in order for the shift register to be free to receive the next frame's information. For example, in a 30 fps display system, a group of pixel cells can receive 30 packets of decoded data each second and use that data to illuminate the pixel cell 30 times each second, as will be discussed below with regard to FIGS. 3A and 3B. The use of shift registers can facilitate the shifting of data through pixel cells in a group of pixels cells but it can also help to reduce the amount of memory in a receptor cell. The above example is one or many processes that can be used to communicate pixel data to the pixel cells, and the structure, time frame, and/or order in which the process occurs are not limited to the above example In various embodiments, each pixel cell includes a light source and the function of activating each pixel cell can include turning on the light source to emit light, and thus form an image on the display. A display system can include a transmitter for encoding pixel data and projecting a stream including the encoded data for reception by receptor cells. For example, transmitter 304 can include a processor 330 and memory 332 for storing computer executable instructions for encoding pixel data. In various embodiments, the processor 330 can operate on the computer executable instructions and encode pixel data.

A projected stream can be modulated, for example, by on/off pulses, by wavelength, and/or by frequency, to encode the pixel data in the projected stream. The task of encoding the data into an optical stream is typically accomplished either by directly manipulating the light source, such as by varying the intensity of the light source, or by using one or more modulators, which are optical devices that can act as electrically controlled switches or irises. That is, a modulator can act as an iris to change the intensity of the light stream (i.e., amount of light) passing through the modulator to various intensity levels. This type of modulation is often used in transmitting analog information. A modulator can also act as a shutter to control the intensity of the stream by changing the intensity between two intensity levels, such as by turning the stream of light on and off, e.g., pulse code modulation (PCM). Some examples of modulator types include Mach-Zehnder interferometric modulators and electro-absorption modulators (EAMs), among others.

Analog techniques for modulation include intensity modulation, amplitude modulation, frequency modulation, and phase modulation, among others. Digital techniques include on-off keying, amplitude shift keying, frequency shift keying, and phase shift keying, among others.

In some embodiments, transmitter 304 can receive instructions for encoding the data in the stream from another device. For example, a computing device can send the instructions wirelessly or through a wired connection to the transmitter.

In various embodiments, the transmitter can include a wired or wireless transmitter. For example, in the embodiment shown in FIG. 3A, the transmitter is a wireless transmitter 304. In various embodiments, wireless transmitters can send encoded pixel data using a variety of techniques, including, but not limited to, light waves that include visible light waves and non-visible light waves (e.g., infrared), and radio signals, among others. In some embodiments, lasers, other types of collimated light, or other optical sources, for example, can be used to transmit the encoded pixel data. Wired transmitters can send encoded pixel data using a variety of techniques, including, but not limited to, cables and wires, among others.

Figure 3A:
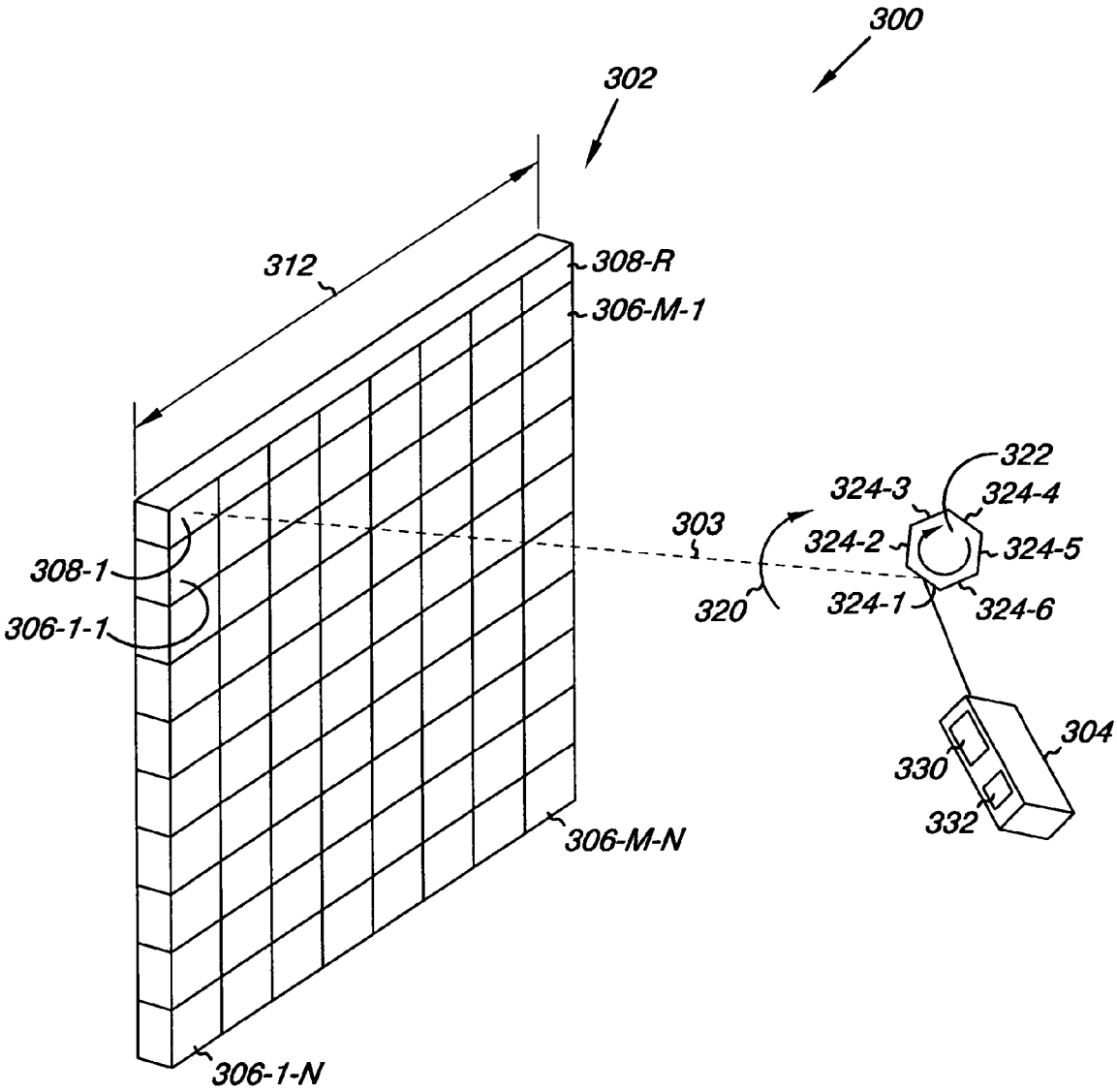
FIG. 3A illustrates another embodiment of a display system.

In the embodiment illustrated in FIG. 3A, transmitter 304 includes a light source for transmitting pixel data 303. The transmitter 304 is positioned at a distance external to the display device 302. The transmitter 304 can operate on an infrared frequency, which is invisible to the human eye, for sending pixel data 303 to receptor cells 308-1 through 308-R. Arrow 320 denotes a scanning movement of the stream of pixel data. This movement can be accomplished by using rotating mirror 322, as will be discussed below, or by another mechanism to move the stream of data from one receptor to another.

Figure 4A:
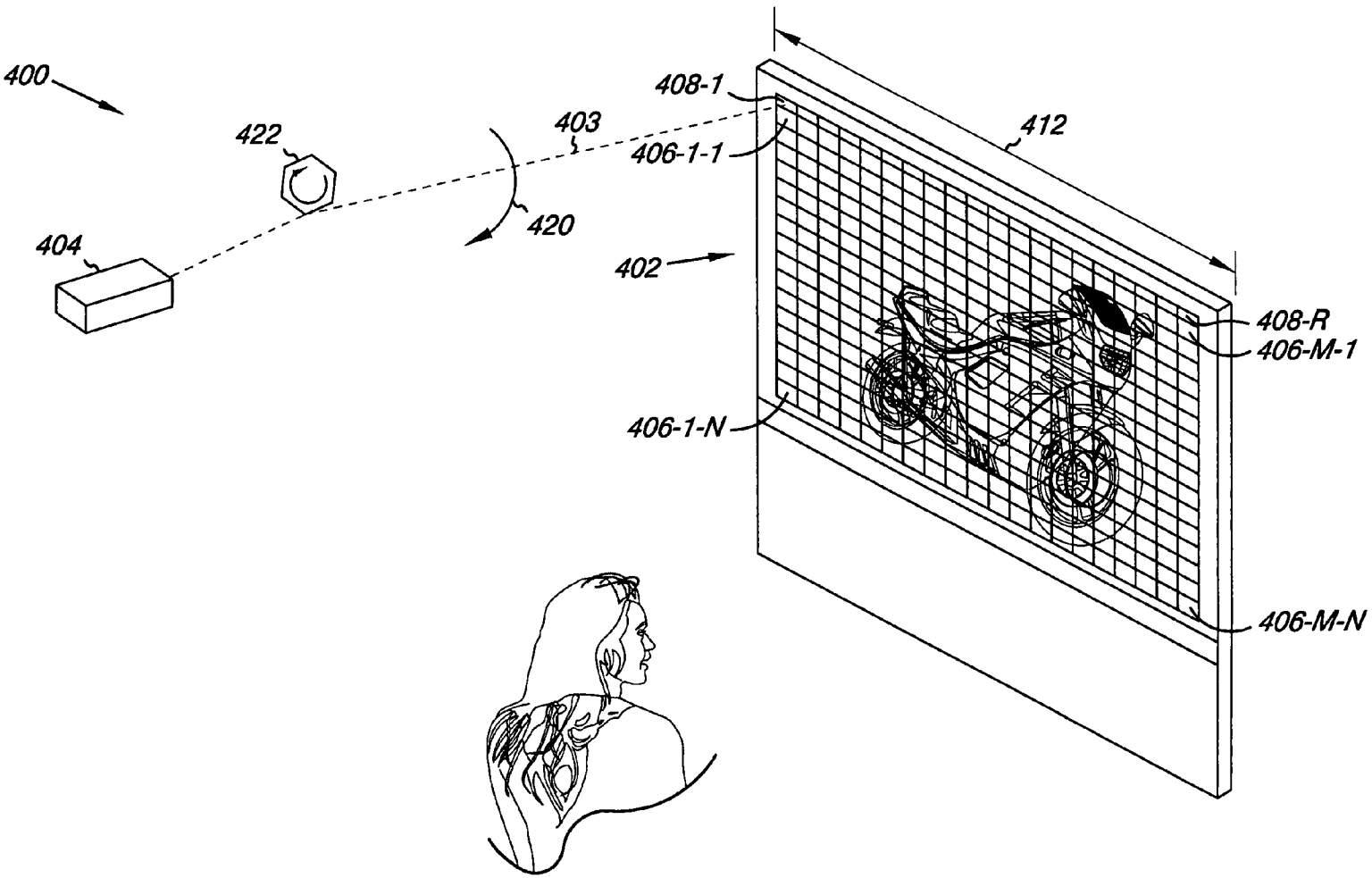
FIG. 4A illustrates an embodiment of a display system with an external transmitter.
Figure 4B:
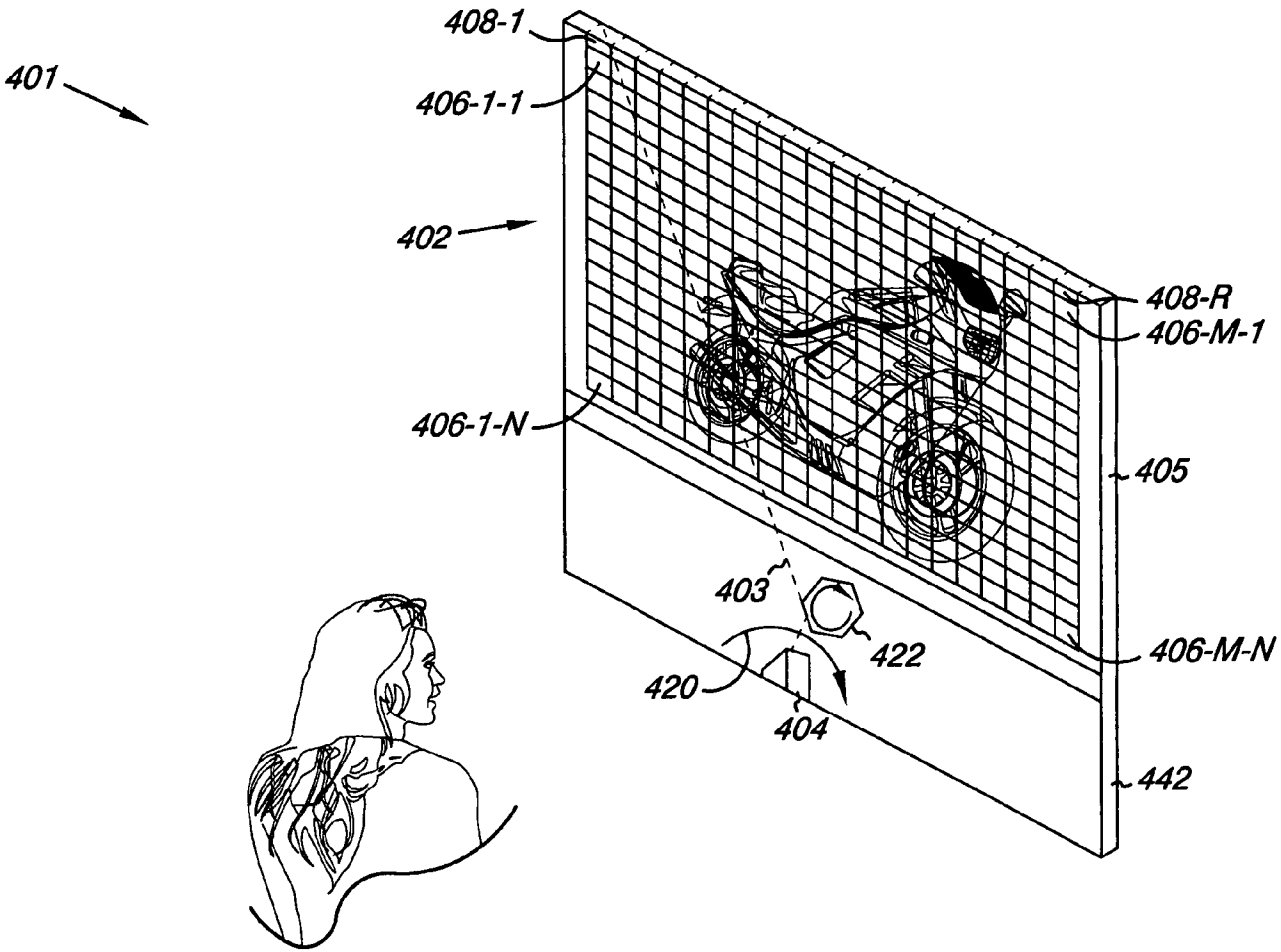
FIG. 4B illustrates an embodiment of a display system with an internal transmitter.

As stated above, in various embodiments, the display system can include a mirror for reflecting the pixel data sent from the transmitter toward the number of receptor cells, e.g., receptor cells 308-1 through 308-R. As illustrated in FIG. 3A, mirror 322 is also positioned at a distance external to the display device 302. The mirror 322 can be moved by various types of motors and can be controlled by computer executable instructions and/or by circuitry provided in and/or with the mirror, motor, and/or transmitter. In other embodiments, one or more mirrors can be positioned within the display device, such as shown in FIG. 4B below.

In various embodiments, the mirror can include a number of facets. For example, in the embodiment of FIG. 3A, mirror 322 includes six facets 324-1 through 324-6. Each facet of the mirror directs a packet of encoded data, e.g., pulse coded data (PCM), to the receptor cells in the number of pixel arrays as the mirror rotates.

For example, as shown in FIG. 3A, transmitter 304 directs a stream of encoded data 303 at the mirror. The mirror 322 reflects the stream of encoded data 303 off facet 324-1 as the mirror rotates and the reflected stream is directed at receptor cells 308-1 to 308-R. As will be discussed below with respect to the embodiment shown in FIG. 3A, each facet of the mirror reflects encoded data for one display frame of data. As the mirror rotates, mirror facets 324-2 through 324-6 intersect the stream of encoded data 303 to send encoded data 303 to receptor cells 308-1 to 308-R. One scan of the display device includes scanning the width 312 of the display device 302, which includes receptor cells 308-1 through 308-R. One revolution of the six faceted mirror scans the display six times, and thus, provides 6 display frames of data per revolution, as will be discussed more thoroughly below.

In various embodiments, the mirror rotation rate can vary. For example, in some embodiments, the rotation rate can be based upon the display frame rate (often measured in frames per second (fps)) and the number of facets in the mirror. In FIG. 3A, for instance, the mirror 322 rotation rate is 300 revolutions per minute (RPM) as indicated by the formula:

30 fps×60 sec per min÷6 facets=300 RPM

Figure 3B:
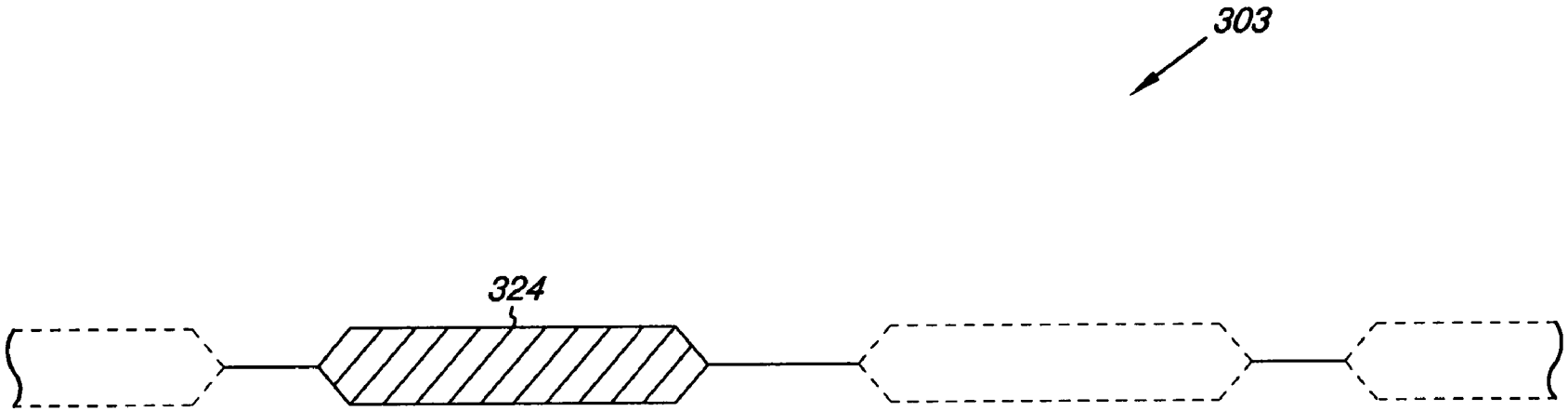
FIG. 3B illustrates an embodiment of a stream of data packets.

FIG. 3B illustrates an embodiment of a stream of data packets transmitted by a light source, such as a laser. In various embodiments, a light source can send pixel data that can be decoded to activate a group of pixel cells in a pixel array. In the embodiment shown in FIG. 3B, the stream of pixel data is provided as a PCM data stream. In various embodiments, the laser is modulated with PCM data such that an entire display frame of data is transmitted as a scan of the full width of the display device is completed. As used herein, a scan is the delivery of an entire display frame of PCM data 324 to all receptor cells of a display device. For example, as shown in FIG. 3B, during each scan, the laser sends packets of PCM data 324 to the receptor cells on the display device. Each packet of PCM data 324 aligns with and corresponds with one receptor cell on the display device.

As shown in FIG. 3B, the stream can include spaces between data packets 324. The spaces can correspond to time intervals of length sufficient to allow for the stream of data to be redirected from one receptor cell to the next receptor cell to which data is to be delivered.

In addition, a transmitter can be aligned with a display device using a variety of methods. For example, the transmitter can send an alignment flag that can be received by one or more receptors. For instance, in some embodiments, the left most receptor cell and right most receptor cell on the display device receive the alignments flags. A receipt signal can be sent, from the display device, back to the transmitter to indicate whether or not the flags have been received. A signal can be sent for one or more flags. The signal can be accomplished through a wired or wireless connection. If the transmitter receives a signal indicating that the flags have been received, then the transmitter can begin or continue sending pixel data. If the transmitter receives a signal indicating that one or more of the flags has not been received, then the transmitter has to delay sending pixel data until alignment is achieved. Alignment can be achieved manually, such as by movement of the transmitter or display device, or by the transmitter. For example, the transmitter can be equipped with a number of mirrors that can be used to redirect the data stream.

In various embodiments, the transmitter can send pulse coded data, as the flag, that is not part of a packet of pixel data. For example, the pulse coded data could be sent just prior or just after sending a packet of pixel data.

In some embodiments, the transmitter can periodically send synchronization data to the display device in order to synchronize the transmission of the data with the illumination of the pixel cells. In such embodiments, one or more receptors can receive timing data, adjust its timing to synchronize its illumination with the transmitter's timing, and, in some embodiments, send a signal to the transmitter indicating continued alignment between the transmitter and the display device.

In some embodiments, when the scan is complete, all receptor cells on the display device that have pixel cells to be changed have received a packet of PCM data 324. In other embodiments, when the scan is complete, all receptor cells on the display device will have received a packet of PCM data 324, even if pixel cells associated with a receptor remain unchanged. Each packet of PCM data can contain all of the display information for the group of pixel cells for the current display frame.

For example, in a 24 bit per pixel display device having a group of pixel cells that includes 768 individual pixel cells, a packet of PCM data would include 18.4 kilobits of data, as indicated by the formula:

24 bits per pixel cell×768 pixel cells per group of pixels cells=18.43 kilobits per packet per group of pixel cells Thus, one 18.4 kilobit packet of PCM data will contain the pixel data for one group of pixel cells in a display device displaying 768 rows of resolution, such as the group of pixel cells 306-1-1 through 306-1-N, wherein N is 768.

In various embodiments, the transmitter data rate expressed in Mega-Hertz (MHz) can vary. Using the formula provided above to calculate the quantity of data in a data packet, a 30 fps display having 768 rows of pixel cells and 1024 columns of pixel cells can produce a transmitter data rate of 566 MHz, as indicated by the following formula:

18.43 kilobits of data per group of pixels×1024 groups of pixel cells 30 fps=566 MHz transmitter data rate In various embodiments, a lower or higher transmitter data rate can be used to accommodate various types of display devices. For example, in some embodiments, receptor cells can be positioned on a plastic display device. In such embodiments, if a transmitter is sending pixel data at a high data rate, e.g., 566 MHz, in some instances the charge mobility on the plastic display device may be too slow for such a high data rate In these embodiments, the transmitter data rate of an individual stream can be reduced by the use of a diode laser array or other such mechanism to transmit multiple streams of data.

A diode laser array includes a number of diode lasers for sending the pixel data to the number of receptor cells via light beams generated by each diode laser. In such embodiments, the transmitter can include any number of diode lasers for sending pixel data. For example, in some embodiments, the transmitter can include 32 diode lasers. The use of 32 diode lasers can reduce the laser data rate to approximately 18 MHz as illustrated in the formula:

18.43 kilobits of data per group of pixels×1024 groups of pixel cells×30 fps÷32 laser diodes=18 MHz per diode laser.

In this example, the diode lasers can each deliver data to a subset (e.g., 1/32) of the entire number of receptor cells. Since the diode laser beam travels 1/32 of the distance of a one laser embodiment, the transmitter can be designed to transmit data at a slower rate over a longer period (e.g., 1/32 of the data rate of a one laser embodiment, but having 32 more periods of time to deliver the data). In this way, the receptor cell receives the same amount of total data, but the beam from the diode laser providing the data to each receptor cell spends a longer time period at each receptor cell.

In some embodiments, the diode laser beams can scan at the same sweep rate as a one laser embodiment, and therefore, since each diode laser has less receptor cells to deliver data to, each diode laser can revisit each of its receptor cells during delivery of a display frame of pixel data. In this way, the receptor cell receives the same amount of total data, but it is delivered in a number of smaller data packets.

Although laser arrays are discussed above, arrays of other types of light sources can be used. Additionally, in some embodiments, multiple transmitters can be used. Light source arrays can be used in parallel, such as to divide the number of receptor cells into smaller groups or to direct multiple data streams to a receptor to communicate more data in less time to each receptor cell. In this way, the transmitter data rate or the data rate of individual streams can be reduced and, therefore, lower data rate components can be used.

Embodiments can also be used in which the transmitter can send pixel data directly to receptor cells without the use of a mirror. In various embodiments, as shown in FIGS. 1, 3A, and 4A, the transmitter can be positioned external to the display device. In some embodiments, the transmitters can be positioned within the display device. Examples of such embodiments will be discussed with respect to FIG. 4B.

FIG. 4A illustrates an embodiment of a display system with an external transmitter. Display system 400 includes display device 402, transmitter 404, and mirror 422. As shown in FIG. 4A, the transmitter 404 is positioned in front of the display device 402 and above viewer 440. In these embodiments, the transmitter can be positioned above a viewer such that the viewer does not obstruct the path of the stream of encoded data.

Transmitter 404 sends a stream of encoded data, e.g., pixel data 403 toward mirror 422. As mirror 422 rotates, indicated by arrow 420, mirror facets on the mirror reflect the pixel data 403 sent from the transmitter toward the various receptor cells 408-1 to 408-R on display device 402. As the mirror continues to rotate, mirror facets on mirror 422 intersect the stream of pixel data 403 to send the pixel data 403 across the width 412 of the top portion of display device 402 such that all receptor cells 408-1 through 408-R, positioned at the top of the display device 402, receive pixel data 403.

One scan of the display device 402, includes scanning the width 412 of the display device 402 one time. A single scan provides one display frame of pixel data to all receptor cells of the display device 402, as discussed with respect to FIGS. 3A and 3B. A display frame is one frame of a video or image on a display device. For example, in a display device operating at 30 frames per second, one frame of video is display every 1/30 of a second.

FIG. 4B illustrates an embodiment of a display system 401 with an internal transmitter. Display system 401 includes display device 405, transmitter 404, and mirror 422. In these embodiments, transmitter 404 and mirror 422 are positioned within the housing 442 of the display device 405. To complement the internally positioned transmitter and mirror, and to provide for thin display device embodiments, the receptor cells 408-1 through 408-R can be oriented at an angle relative to pixel cells 406-1 to 406-N in one or more spatial dimensions. In some embodiments, the receptor cells can be oriented at a 90 degree angle in one dimension.

Figure 4C:
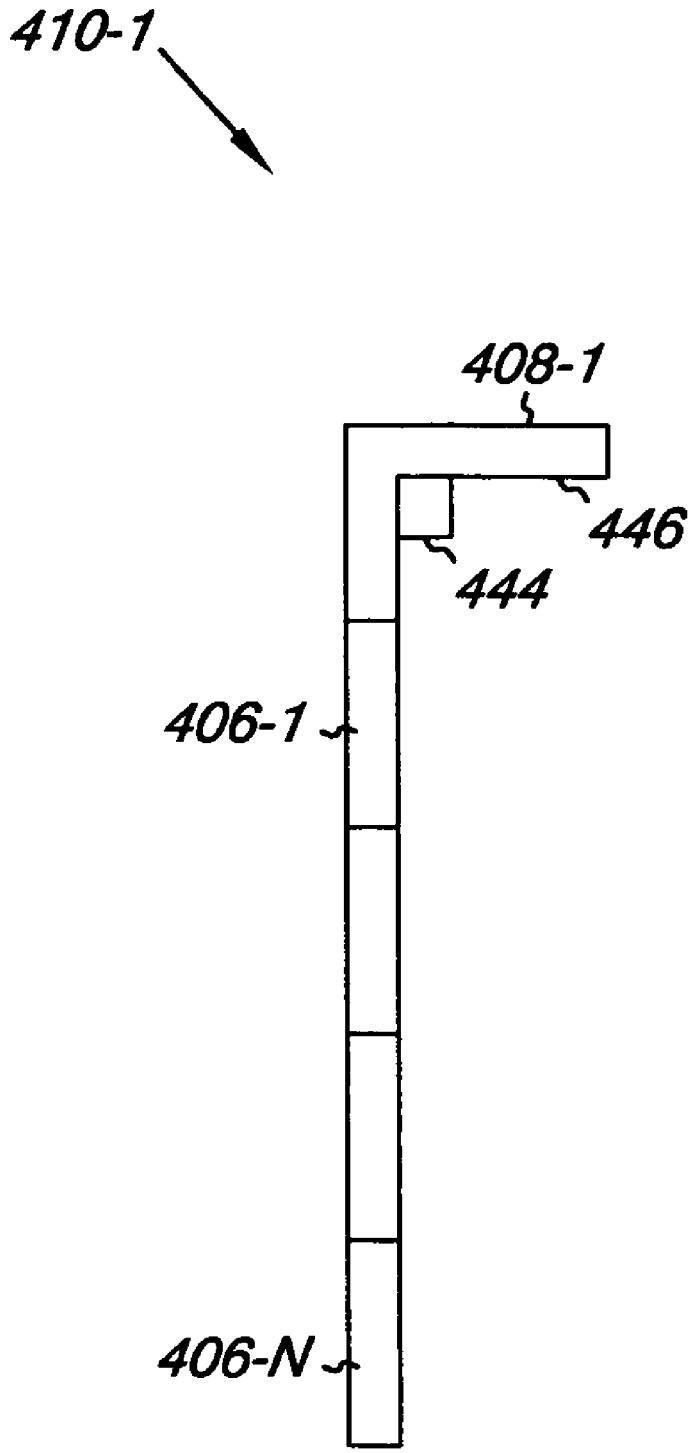
FIG. 4C illustrates an embodiment of a receptor cell.

FIG. 4C illustrates an embodiment of a receptor cell that can be used in embodiments such as that shown in FIG. 4B. In this receptor cell embodiment, the receptor cell includes a 90 degree angle relative to the pixel cells 406-1 to 406-N. Receptor cells positioned at an angle or those having an angle relative to the pixel cells can provide for a transmitter to be positioned within the display device and behind the display of the display device and, therefore, provide for very slim rear projection display devices. As shown in FIG. 4C, receptor cell 408-1 includes angle 444, which is a 90 degree angle, and receiving surface 446. Receiving surface 446 can include receptor diodes, such as receptor diode 209 illustrated in FIG. 2C, for receiving encoded data from a transmitter. Circuitry for coupling the receptor cell and pixel cells can allow for the receptor cell to convey decoded data to pixel cells in a group of pixel cells, as for example, the group of pixel cells 406-1 to 406-N, illustrated in FIG. 4C.

In some embodiments, a number of mirrors can be used to angle the stream of pixel data to the receptor cells of the display device. In such embodiments, a number of mirrors can be provided within the display device and the receiving surface of the receptors can be oriented on the back side (within the display device) to receive the pixel data.

In some embodiments, display device 405 can include a number of transmitters or light sources. For example, display device 405 can include 32 laser diodes positioned at the base of display device 405 and at the rear of the display of display device 405. As discussed above, the use of multiple laser diodes can provide for a lower data rate.

In other embodiments, a transmitter can be used to direct pixel data to a single receptor cell on the display device. In such embodiments, all of the data to display an image can be received by the single receptor cell. In these embodiments, no mirrors would have to be used to move the stream of data. The circuitry, processors, memory, and other components can be implemented on the single receptor cell. The single receptor cell can receive encoded data and decode the encoded data using a processor and program instructions stored in memory. In such embodiments, the single cell receptor can convey the decoded data to every pixel cell on the display device to form an image.

Although specific embodiments have been illustrated and described herein, it will be appreciated from this disclosure that any arrangement calculated to achieve the same techniques can be substituted for the specific embodiments shown. This disclosure is intended to cover any and all adaptations or variations of various embodiments of the present disclosure.

It is to be understood that the above description has been made in an illustrative fashion, and not a restrictive one. Combination of the above embodiments, and other embodiments not specifically described herein will be apparent upon reviewing the above description.

The scope of the various embodiments of the present disclosure includes any other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the present disclosure have to include more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A display system, comprising:

a display device including:

a number of pixel cells, wherein each of the pixel cells includes a light source; and a number of receptor cells, wherein each receptor cell is coupled to a group of pixel cells within the number of pixel cells; and a transmitter configured to wirelessly send pixel data as an optical stream individually to each of the receptor cells, wherein each receptor cell is configured to individually receive the pixel data from the transmitter and to convey the pixel data to the group of pixel cells to which the receptor cell is coupled to cause the light sources of the pixel cells to be selectively activated.

2. The display system of claim 1, wherein the group of pixel cells includes a column of pixel cells.

3. The display system of claim 2, wherein one of the number of receptor cells is positioned at a top of the column of pixel cells to form a pixel array.

4. The display system of claim 3, wherein a number of pixel arrays are positioned next to each other to form a display on the display device.

5. The display system of claim 1, wherein the pixel data includes data to activate each pixel cell in the number of pixel cells.

6. The display system of claim 1, wherein the pixel data includes pulse coded data.

7. The display system of claim 6, wherein the pulse coded data includes a packet of data for providing a pixel array with one display frame of data.

8. The display system of claim 1, wherein the pixel data includes data to selectively activate each pixel cell in the group of pixel cells.

9. The display system of claim 1, including a mirror having a number of facets, wherein each facet of the mirror directs one display frame of data to the number of receptor cells.

10. The display system of claim 9, wherein the receptor cells are oriented at an angle relative to the pixel cells.

11. The display system of claim 10, wherein the receptor cells include a portion oriented at an angle relative to the pixel cells.

12. The display system of claim 1, further comprising:

a mirror for reflecting the pixel data sent from the transmitter toward the number of receptor cells, wherein the mirror is configured to move the optical stream sent from the transmitter to direct the optical stream to individual receptor cells.

13. The display system of claim 12, wherein the transmitter includes a laser for sending the pixel data to the number of the receptor cells.

14. The display system of claim 13, wherein the laser is positioned external to the display device.

15. The display system of claim 14, wherein the transmitter includes a number of diode lasers for sending the pixel data to the number of receptor cells.

16. The display system of claim 12, wherein the mirror is positioned external to the display device.

17. The display system of claim 12, wherein the receptor cells are aligned with each other in one dimension and oriented at an angle relative to the pixel cells.

18. The display system of claim 17, wherein the receptor cells are oriented at a 90 degree angle in one dimension.

19. The display system of claim 18, wherein the transmitter is positioned to transmit a stream of pixel data toward the receptor cells, and wherein the transmitter is positioned such that the stream is generally parallel relative to the pixel cells in one dimension.

20. The display system of claim 18, wherein the transmitter is positioned below the receptor cells and behind the pixels cells.

21. The display system of claim 12, wherein the transmitter is positioned within the display device.

22. The display system of claim 1, wherein the display device is an optically addressable display.

23. The display system of claim 1, wherein at least one of the number of receptor cells is configured to receive encoded pixel data in the form of multiple streams of pixel data received in parallel.

24. The display system of claim 23, wherein the at least one of the number of receptor cells is configured to decode the encoded pixel data and to convey the decoded pixel data to the group of pixel cells to which the at least one of the number of receptor cells is coupled.

25. The display system of claim 1, wherein the display device is configured to receive pixel data in parallel with a first receptor cell and a second receptor cell of the number of receptor cells.

26. The display system of claim 1, wherein each pixel cell includes a number of shift registers for holding pixel data.

27. The display system of claim 1, wherein each receptor cell includes computer executable instructions for selecting which pixel cell to send pixel data.

28. The display system of claim 1, wherein the display device further comprises circuitry coupling groups of pixel cells with respective receptor cells, wherein the receptor cells are configured to receive encoded data sent from a transmitter, to decode the encoded data and to convey the decoded data to the respective groups of pixel cells to activate the pixel cells in the groups of pixel cells.

29. The display system of claim 28, wherein each packet of encoded data includes data to activate pixel cells in an array.

30. The display system of claim 28, wherein each of the receptor cells includes a receptor diode for receiving the encoded data and circuitry for decoding the encoded data and conveying decoded data to a number of pixel cells within the group of pixel cells.

31. The display system of claim 28, wherein each pixel cell includes a light emitter and circuitry for receiving the decoded data and activating the light emitter based on the decoded data.

32. The display system of claim 28, wherein the receptor cells are oriented at an angle relative to the pixel cells.

33. The display system of claim 21, wherein the receptor cells include a portion oriented at an angle relative to the pixel cells.

34. The display system of claim 28, wherein at least one of the number of receptor cells is configured to receive encoded pixel data in the form of multiple streams of pixel data received in parallel.

35. The display system of claim 28, wherein the display device is configured to receive pixel data in parallel with a first receptor cell and a second receptor cell of the number of receptor cells.

36. The display system of claim 28, wherein each pixel cell includes a number of shift registers for holding pixel data.

37. The display system of claim 28, wherein each receptor cell includes computer executable instructions for selecting which pixel cell to send pixel data.

38. The display system of claim 1, wherein each receptor cell includes a configuration to receive encoded pixel data including location, color, and intensity pixel data, wherein each receptor cell includes a configuration to decode the encoded pixel data, and wherein each receptor cell is configured to convey the decoded color and intensity pixel data to the group of pixel cells.

39. The display system of claim 38, wherein each receptor cell includes a configuration to convey the decoded color and intensity pixel data to the group of pixel cells based upon the decoded location pixel data.

40. The display system of claim 38, wherein the group of pixel cells includes a column of pixel cells.

41. The display system of claim 40, wherein one of the number of receptor cells is positioned at a top of the column of pixel cells to form a pixel array.

42. The display system of claim 40, wherein a number of pixel arrays are positioned next to each other to form a display on the display device.

43. The display system of claim 38, wherein the pixel data includes data to activate each pixel cell in the number of pixel cells.

44. The display system of claim 38, wherein the pixel data includes pulse coded data.

45. The display system of claim 44, wherein the pulse coded data includes a packet of data for providing a pixel array with one display frame of data.

46. The display system of claim 38, wherein the pixel data includes data to activate each pixel cell in the group of pixel cells.

47. The display system of claim 38, including a mirror having a number of facets, wherein each facet of the mirror directs one display frame of data to the number of receptor cells.

48. A method for forming an image on a display device having a number pixel cells and a number of receptor cells, wherein each receptor cell is coupled to a group of pixel cells, said method comprising:

wirelessly sending encoded pixel data as an optical stream individually to each of the receptor cells from a transmitter;

in the receptor cells, individually receiving the encoded pixel data;

decoding the encoded pixel data with circuitry included within each receptor cell; and transmitting the decoded pixel data to the group of pixel cells to which the receptor cells are respectively coupled, wherein the pixel cells are configured to selectively activate respective light sources based upon information contained in the decoded pixel data.

49. The method of claim 48, wherein transmitting the decoded pixel data further comprises transmitting a packet of data to a number of receptor cells that are coupled to the receptor cell.

50. The method of claim 48, further including activating a light source of each pixel cell based on the decoded data.

51. The method of claim 48, wherein the data includes data representing one full display frame of data on a display device.

52. The method of claim 48, wherein transmitting the decoded data to the group of pixel cells includes transmitting the decoded data to a number of shift registers within each pixel cell.

53. The method of claim 48, wherein receiving encoded data in a receptor cell of a pixel array includes receiving encoded data in the form of multiple streams of data received in parallel.

54. The method of claim 48, wherein receiving encoded data in a receptor cell of a pixel array includes receiving data in parallel with a first receptor cell and a second receptor cell.

55. The method of claim 48, wherein receiving encoded data further comprises receiving encoded data including color, and intensity pixel data in the receptor cell.

56. The method of claim 48, wherein each of the receptor cells include circuitry for decoding the pixel data, and wherein receiving encoded data further comprises receiving the encoded pixel data in the form of multiple streams of pixel data and decoding the pixel data with the decoding circuitry included within each receptor cell.

* * * * *

UNITED STATES PATENT AND TRADEMARK OFFICE

CERTIFICATE OF CORRECTION

PATENT NO. : 7,733,298 B2
APPLICATION NO. : 10/969401
DATED : June 8, 2010
INVENTOR(S) : Daryl E. Anderson et al.

It is certified that error appears in the above-identified patent and that said Letters Patent is hereby corrected as shown below:

In column 12, line 30, in Claim 33, delete "claim 21," and insert -- claim 32, --, therefor.

Signed and Sealed this

Twenty-eighth Day of September, 2010

David J. Kappos

David J. Kappos
*Director of the United States Patent and Trademark Office*